US011255021B2

(12) United States Patent
Dietrich et al.

(10) Patent No.: US 11,255,021 B2
(45) Date of Patent: Feb. 22, 2022

(54) AQUEOUS FORMULATION FOR CREATING A LAYER OF GOLD AND SILVER

(71) Applicant: FRAUNHOFER-GESELLSCHAFT ZUR FÖRDERUNG DER ANGEWANDTEN FORSCHUNG E. V., Munich (DE)

(72) Inventors: Lothar Dietrich, Berlin (DE); Morten Brink, Berlin (DE); Hermann Oppermann, Berlin (DE)

(73) Assignee: Fraunhofer-Gesellschaft zur förderung der angewandten Forschung e.V., Munich (DE)

( * ) Notice: Subject to any disclaimer, the term of this patent is extended or adjusted under 35 U.S.C. 154(b) by 54 days.

(21) Appl. No.: 16/805,797

(22) Filed: Mar. 1, 2020

(65) Prior Publication Data

US 2020/0283922 A1 Sep. 10, 2020

(30) Foreign Application Priority Data

Mar. 4, 2019 (DE) ..... 10 2019 202 899.3

(51) Int. Cl.

| | |
|---|---|
| ***C25D 3/62*** | (2006.01) |
| ***C25D 3/46*** | (2006.01) |
| ***C25D 3/48*** | (2006.01) |
| ***C25D 5/02*** | (2006.01) |
| ***C25D 5/00*** | (2006.01) |
| ***C25D 5/08*** | (2006.01) |

(52) U.S. Cl.

CPC ..... *C25D 3/62* (2013.01); *C25D 3/46* (2013.01); *C25D 3/48* (2013.01); *C25D 5/02* (2013.01); *C25D 5/08* (2013.01); *C25D 5/617* (2020.08); *C25D 5/623* (2020.08)

(58) Field of Classification Search

None

See application file for complete search history.

(56) References Cited

U.S. PATENT DOCUMENTS

| | | | | | |
|---|---|---|---|---|---|
| 3,475,292 | A * | 10/1969 | Shoushanian | C25D 3/62 205/242 |
| 4,067,784 | A * | 1/1978 | Leahy | C25D 3/46 205/263 |
| 4,088,549 | A | 5/1978 | Deuber et al. | |

FOREIGN PATENT DOCUMENTS

| | | |
|---|---|---|
| CH | 629259 A5 | 4/1982 |
| WO | WO 02/101119 A1 | 12/2002 |

* cited by examiner

*Primary Examiner* — Louis J Rufo

(74) *Attorney, Agent, or Firm* — Leydig, Voit & Mayer, Ltd.

(57) ABSTRACT

The invention relates to a cyanide-free formulation for the electrodeposition of a layer of gold and silver on electrically conductive substrates, wherein the formulation respectively contains a complexing agent from the group of sulfites and thiosulfates and is characterized in that at least one transition metal from the 5th or 6th sub-group is added in the form of the soluble oxygen acid thereof in order to increase the bath stability.

21 Claims, No Drawings

AQUEOUS FORMULATION FOR CREATING A LAYER OF GOLD AND SILVER

This patent application claims the benefit of German Patent Application No. 10 2019 202 899.3, filed on Mar. 4, 2019, the disclosure of which is incorporated herein by reference in its entirety for all purposes.

The invention relates to a cyanide-free formulation for the electrodeposition of a layer of gold and silver on electrically conductive substrates, wherein the formulation respectively contains a complexing agent from the group of sulfites and thiosulfates and is characterized in that at least one transition metal from the 5th or 6th sub-group is added in the form of the soluble oxygen acid thereof in order to increase the bath stability.

Furthermore, the invention relates to a galvanic process for the production of alloy deposits using the formulation according to the invention in that the substrate to be coated is immersed in the process solution and, when an electric field is applied between the cathodically polarized substrate and at least one anodically polarized counter electrode, a simultaneous reduction of gold ions and silver ions takes place on the substrate surface.

INTRODUCTION

The present invention is in the field of aqueous electrolytes for electrodeposition, especially in the field of cyanide-free electrolytes for electrodeposition of alloys of gold and silver. Depending on the type of substrate used, the deposition can be carried out either in the form of a layer in the case of a full-area coating or in the form of individual deposits in the case of a partial coating on a masked surface.

Such galvanically produced deposits are particularly suitable for the assembly and connection technology in microelectronics and for microsystem technology. In the fields of application mentioned, thin metallic layers in the form of conductor track levels are used to build semiconductors, in the form of contact structures for connecting active and passive semiconductor components, but also in the form of defined rigid or movable microstructures for the production of actuators and sensors.

A special feature of the deposited gold deposits is their ability to chemically or electrochemically transform the silver into porous gold having a skeletal structure by means of selective etching. The formation of this open-pore structure by alloying takes place in gold alloys having a silver content of about 20 to 50 percent by weight and is based on the effect of the surface diffusion of gold atoms. The gold deposits having low density and large active surface created in this way not only allow the use of novel chip connection technologies, but also provide versatile substrate surfaces for applications in sensor technology, for example for chemisorptive and physisorptive processes, or for use in biotechnology, for example for connecting living organic material.

Compared to other manufacturing technologies, the galvanic method is characterized by its precise molding of masking openings, such as those formed by lithographically structured photoresist. Lateral opening sizes of less than 1 micrometer can be molded as well as opening sizes of several millimeters. Depending on the application, layer thicknesses of a few 10 nanometers up to several 10 micrometers are required. A weakly acidic to weakly alkaline pH value of the electrolyte is advantageous for the special purpose of electrodeposition in a prefabricated mask which has been produced using an aqueous alkaline developable photoresist system.

PRIOR ART

Stable aqueous electrolytes for the deposition of gold and silver are usually based on cyanide compounds in which the gold is bound as a cyanoaurate complex and the silver as a cyanoargentate complex. Such baths are described for example in the patent specifications WO 02/101119 or CH 629259.

For the purpose of current carrying capacity, such electrolytes contain inorganic and/or organic acids and the salts thereof. The formulation described in CH 629259 contains potassium pyrophosphate as the conductive salt.

In order to delay the mechanism of time-dependent and light-induced silver precipitation, additional stabilizers such as amino acids or larger amounts of free cyanide are usually added. In WO 02/101119, larger amounts of free cyanide in the form of potassium salt are added to the electrolytes.

In order to be able to deposit closed and fine-grained layers from such electrolytes under direct voltage, the solutions are usually admixed with certain organic compounds as gloss additives or levelers. Such inhibitors expand the applicable current density range for the production of uniform and fine crystalline layers and/or shift said range towards higher current densities. The use of higher current densities in turn enables higher separation speeds. WO 02/101119 describes a mixture of a dithiocarbamoyldithiocarbazate and a xanthate, which can be used especially in cyanide gold and silver electrolytes as a gloss-forming additive. In CH 629259, alkylene polyamines and alkyleneimine polymers are proposed as bath additives to achieve shiny alloy layers made of gold and silver.

The use of toxic cyanide substances in aqueous process solutions is known to pose problems for both the manufacturer and the user with regard to the high risk potential, especially with regard to the transport of dangerous goods, occupational health and safety, and disposal. In order to circumvent these difficulties, great efforts have been made in the past decades to develop cyanide-free formulations for the electrodeposition of gold and silver. While suitable complexing agents were found here for the sole deposition of gold or silver, no stable formulations for industrial use have been developed for the simultaneous deposition of gold and silver for the production of alloy layers. None of these new systems has found its way into practical electroplating technology and has so far been implemented industrially. As an alternative to the electrolyte system based on thiosulfate and sulfite, other organic complexing agents show neither a sufficiently strong complexation of the noble metals nor a sufficiently high stability to electrolysis.

DESCRIPTION

Proceeding from this, it was therefore the object of the present invention to find an improved formulation for a stable aqueous solution which, owing to the toxicity mentioned above, contains no cyanide compounds and which enables the galvanic deposition of alloys from gold and silver in the largest possible concentration range. The stability of the solution with regard to the effects of air, light, heat, and current flow must be such that there is no clouding of the solution during use and, if possible, no precipitation of elemental silver or other reaction products in the form of particles or deposits.

In addition, it was an object of the present invention to provide a method for the deposition of alloys from gold and silver on approximately plate-shaped or foil-like substrates, with which closed layers or isolated alloy deposits can be produced using the formulation according to the invention. In this case, a uniform, fine-crystalline and pore-free structure down to a layer thickness of 100 μm is required over the largest possible current density range. Furthermore, the gold content in the alloy should be selectively adjustable within an extended concentration range of 15 percent by weight to 85 percent by weight.

This object is achieved by the features of the cyanide-free, metal salt containing aqueous formulation described herein, and the method for the electrodeposition of a layer of gold and silver on an electrically conductive substrate described herein, as well as the advantageous developments thereof.

The invention thus relates to a cyanide-free, metal salt-containing aqueous formulation for the electrodeposition of a layer of gold and silver on an electrically conductive substrate, which contains at least one gold salt and at least one silver salt and also at least two types of complexing agents, namely at least one first complexing agent from the group of the thiosulfates and at least one second complexing agent from the group of the sulfites. In addition, the formulation contains at least one soluble oxygen acid of a transition metal from the 5th group (vanadium group) and the 6th group (chrome group) of the periodic table.

Accordingly, a cyanide-free system has been selected in which monovalent gold ions and monovalent silver ions are preferably present in a mixed alkali solution, preferably in a weakly alkaline solution, with sulfite and thiosulfate.

For this purpose, the gold is used in the form of the disulfitoaurate complex, preferably as sodium gold sulfite ($Na_3Au(SO_3)_2$), ammonium gold sulfite ($(NH_4)_3Au(SO_3)_2$), or a combination thereof.

The silver is added together with one of the ligands thereof as silver thiosulfate ($Ag_2S_2O_3$) or in the form of silver (I) salts, preferably as silver chloride (AgCl), silver bromide (AgBr), silver iodide (AgI), silver carbonate ($Ag_2CO_3$), silver acetate ($Ag(CH_3COO)$), or a combination thereof, by dissolving it by adding thiosulfate salts in a stoichiometric ratio of at least 1 part thiosulfate to 1 part silver in aqueous solution as a dithiosulfato argentate complex.

Since the mixed complexes of the noble metals that are formed in the presence of sulfite and thiosulfate alone do not have sufficient stability and spontaneously decompose in a short period of time, further effective stabilizers for extending the service life of the aqueous solution must be found and added.

In a first improvement of the formulation, additional thiosulfate ions are added in excess to the aqueous solution with the complexed gold and silver ions. The free thiosulfate ions shift the equilibrium of the complex formation reactions with gold and silver in favor of the complex activity. The thiosulfate can be added as the salt of thiosulfuric acid, preferably as the ammonium salt, sodium salt, or potassium salt. The use of these compounds in the gold/silver electrolyte according to the invention is advantageously in a concentration range from 0.2 mol/l to 1.5 mol/l, preferably between 0.5 mol/l and 1 mol/l.

In a second improvement of the formulation, additional sulfite ions are added in excess to the aqueous solution having the complexed noble metal ions and the free thiosulfate ions. The free sulfite ions stabilize the thiosulfate and prevent sulfur precipitation from the noble metal complexes. The sulfite can be added as the salt of the sulfurous acid or as the salt of the disulfurous acid, preferably as the ammonium salt, sodium salt, or potassium salt. The use of these compounds in the gold/silver electrolyte according to the invention is advantageously in a concentration range from 0.1 mol/l to 1 mol/l, preferably between 0.2 mol/l and 0.5 mol/l.

Surprisingly, it has now been found that a further improvement in the formulation is achieved if a soluble oxygen acid of a transition metal of the 5th and 6th subgroup of the periodic table, in particular vanadium, chromium, molybdenum, and tungsten, having the function of a stabilizer for the purpose of extending the service life, is added to the cyanide-free electrolytes based on thiosulfate and sulfite for the deposition of alloys made of gold and silver. These oxygen acids of the transition metals can either be used in the form of their soluble salts, preferably as vanadate ($VO_3^-$), orthovanadate ($VO_4^{3-}$), chromate ($CrO_2^{4-}$) or dichromate ($Cr_2O_7^{2-}$), molybdate ($MoO_4^{2-}$), or tungstate ($WO_4^{2-}$), and/or can be added or in the form of their isolated metallic acids, preferably molybdic acid ($H_2MoO_4$) or tungsten acid ($H_2WO_4$), or in the form of the anhydrides of these metal acids, preferably as vanadium pentoxide ($V_2O_5$), chromium trioxide ($CrO_3$), molybdenum trioxide ($MoO_3$) or tungsten trioxide ($WO_3$). These substances can be contained in the formulation according to the invention in a concentration of 0.1 mmol/l to 1000 mmol/l, preferably from 1 mmol/l to 50 mmol/l, but at most up to their solubility limit.

It also happened to be found that polymeric carboxylates have a positive influence on bath stability. These additives allow buffering of the free hydroxyl ions and dispersion of elemental silver in a synergistic effect, with the consequence that the pH stability of the solution is increased and the tendency to form precipitates is further reduced. Accordingly, the formulation according to the invention can contain at least one substance from the group of the polymerized carboxylic acids, primarily the acrylic acid polymers (I), methacrylic acid polymers (II) or acrylic acid-maleic acid copolymers (III) of the general formula (IV)

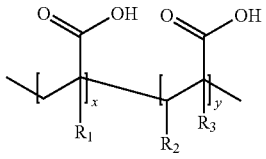

wherein, in the substance group (I), $R_1$, $R_2$, and $R_3$ each is a hydrogen ion, in the substance group (II), $R_1$ and $R_3$ each is a methyl group and $R_2$ is a hydrogen ion, and in the substance group (III), $R_1$ and $R_3$ each is a hydrogen ion and $R_2$ is a carboxyl group. The multipliers "x" and "y" are determined by the average chain length of the polymer and can take any value. The bath additives according to formula (IV) have sufficient water solubility and the required electrochemical resistance. The use of these polymeric compounds in the gold/silver electrolyte according to the invention is advantageously in a concentration range of 1 g/l to 100 g/l, preferably between 5 g/l and 50 g/l.

In aqueous solutions, the free sulfite is oxidized to sulfate by the dissolved atmospheric oxygen in a time and temperature-dependent function. Furthermore, the free sulfite is also forced to oxidize by the anode reactions during the galvanic coating process. Hydrocarbon compounds with functional aldehyde or keto groups are known to counteract these undesirable reactions. Accordingly, at least one substance from the group of ketocarboxylic acids, preferably acetoacetic acid, oxaloacetic acid, α-ketoglutaric acid, 2-ketobutyric acid, or levulinic acid, can be added to the gold/silver electrolyte in the form of the acid or the salt thereof to delay the sulfite oxidation. The use of these compounds in the gold/silver electrolyte according to the invention is advantageously in a concentration range of 1 g/l to 100 g/l, preferably between 5 g/l and 25 g/l.

To buffer the pH in the aqueous solution and to maintain the basicity in the anode film during the electrodeposition, the formulation according to the invention can also contain at least one buffer substance from the group of aliphatic polycarboxylic acids, preferably oxalic acid, malonic acid or succinic acid, from the group of hydroxycarboxylic acids, preferably malic acid, tartaric acid, glycolic acid, gluconic acid, lactic acid, or citric acid, or from the group of weak polyprotonic inorganic acids, preferably phosphoric acid or carbonic acid. The use of these compounds in the gold/silver electrolyte according to the invention is advantageously in a concentration range from 1 g/l to 100 g/l, preferably from 5 g/l to 25 g/l.

So-called grain refiners or so-called gloss agents can be added to the formulation according to the invention in order to adjust the grain size in a targeted manner. These substances inhibit crystal growth and usually lead to an increased polarization of the cathodic metal reduction.

To improve the wettability, the formulation according to the invention can contain further surface-active substances which, as so-called wetting agents or surfactants, reduce the surface tension of the solution. These organic substances can be present in the solution as anionic, cationic, amphoteric, or nonionic molecules.

In order to set a desired gold content in the deposited alloy in the range from 15 percent by weight to 85 percent by weight, the formulation according to the invention can contain the gold in a concentration of from 2 g/l to 60 g/l, preferably from 8 g/l to 24 g/l, and the silver in a concentration of from 1 g/l to 60 g/l, preferably from 3 g/l to 15 g/l.

In addition to the noble metal content, a change in other coating parameters, in particular the bath temperature, current density, and flow strength, can influence the resulting alloy ratio. The desired gold content in the deposited layer or in the deposited deposits can be specifically adjusted by shifting the gold ion and silver ion concentration in the process solution. By changing at least one further coating parameter, preferably the current density, the temperature, or the flow of liquid, the alloy ratio is additionally influenced in such a way that an increase in current density alone increases the gold content; an increase in temperature or an increase in the inflow strength on the other hand lowers the gold content. In the case of the galvanic coating of masked substrates, the resulting alloy ratio is additionally influenced by the design of the electroplating mask in such a way that structures with larger dimensions tend to have a gold-rich alloy, an increasing density of deposits results in local gold enrichment within the densified zone, and an overall increasing proportion of the area of the lithographically opened areas in the masking also leads to an overall gold-richer deposition.

Because of the tendency of the thiosulfate to decompose in acidic solution, a galvanic bath with the formulation according to the invention can be operated in the neutral or basic pH range. The aqueous solution can suitably have a pH of 6.5 to 12, preferably between 7 and 9.

In addition, the present invention relates to a method for the electrodeposition of a layer of gold and silver on an electrically conductive substrate, in which the formulation according to the invention described above is used. In the method according to the invention, the substrate is completely or partially immersed in the formulation and the layer of gold and silver is deposited by applying an electrical voltage between the cathodically polarized substrate and at least one anodically polarized counter electrode.

In a technical process, the substrate to be processed is brought into contact with the process solution according to the invention, so that the surface to be coated is completely wetted by the liquid and flowed over by means of a suitable device for the purpose of uniform mass transport. This can be done, for example, in a way in which the substrate is completely or partially immersed in a basin filled with the liquid, or in a way in which the substrate is fixed on a basin and the surface to be coated is exposed to the liquid from below.

A suitable device for uniformly exposing substrates having a plate-like or sheet-like shape to the liquid is, for example, a paddle or lamella-like body which moves parallel to the substrate surface. In a further embodiment, an inflow can be brought about through one or more nozzles through which the electrolyte is directed onto the substrate surface with increased liquid pressure. In the event of an additional relative movement between the nozzles and the substrate, a static flow profile can be counteracted and, as a result, the flow distribution can be improved. In the simplest version, the liquid movement on the substrate surface is brought about by circulating the liquid reservoir in the galvanic cell by means of an agitator or a pump circuit.

For the purpose of galvanic metal deposition, an electric field is applied between the wetted substrate and at least one counter electrode located in the electrolyte, wherein the reduction of the noble metal ions on the cathodically polarized substrate and the oxidation reactions to the charge neutrality of the solution are forced on the anodically polarized counter electrodes. The electric field can be static in the form of a DC voltage or pulsed rectified in the form of a pulsed DC voltage.

The counter-electrode bodies used in the method according to the invention consist of a material which is insoluble in the electrolyte and has a low overvoltage for water decomposition, preferably made of platinum, platinized titanium, or of mixed metal oxide-coated titanium base material. In principle, electrode bodies of almost any shape, but preferably plate anodes or grid anodes, can be used.

A large number of technical fields of application are conceivable for the layers of gold and silver described above. The layers can be used in surface technology for the corrosion protection of oxidation-sensitive base metals such as nickel or copper. Furthermore, the deposits produced with the formulation according to the invention can serve as electrical contact elements for connecting components from semiconductor and printed circuit board technology.

Another property of the electrodeposited alloy deposit mentioned at the outset is the possibility of producing porous gold sponges having a nanoscale pore size by removing the silver content by means of selective etching. The metal structures having low density that form here can prove to be advantageous in a wide variety of fields of application, for example as a permeable carrier in filter technology, as a compressive contact metal in chip connection technology or for purposes in bionics and sensor technology. Due to the extremely large metal surface compared to the occupied substrate surface, the use of gold sponges is also advantageous where catalytic reactions take place on gold surfaces.

The formulation according to the invention of an aqueous solution for the electrodeposition of alloys from gold and silver is described in more detail in the examples below.

Comparative Example 1

An aqueous solution with
4.7 g/l gold in the form of sodium disulfitoaurate
6 g/l silver in the form of silver chloride
19.7 g/l sodium thiosulfate pentahydrate
is prepared in accordance with a stoichiometric ratio of 1 part of thiosulfate ions to one part of noble metal ions and adjusted to a pH of 7.9. The solution is clear at first. If a conductive substrate with a platinized counter electrode is immersed in the solution with the formulation according to Example 1 and a voltage is applied at 40° C. with a resulting cathodic current density of 0.5 A/dm$^2$, the solution immediately becomes brown.

Comparative Example 2

An aqueous solution is prepared with an identical formulation as in Example 1 and adjusted to a pH of 7.9. The solution is clear at first. After 12 days in a closed vessel at 21° C. under artificial light, a powdery black precipitate appeared.

Comparative Example 3

An aqueous solution with
7.5 g/l gold in the form of sodium disulfitoaurate
7.5 g/l silver in the form of silver chloride
90 g/l sodium thiosulfate pentahydrate
30 g/l sodium sulfite
is prepared and adjusted to a pH of 8.0. The solution is clear at first. After 12 days in a closed vessel at 21° C. under artificial light, only a few black particles were excreted, while the solution remained clear.

Example 4

An aqueous solution with
7.5 g/l gold in the form of sodium disulfitoaurate
7.5 g/l silver in the form of silver chloride
90 g/l sodium thiosulfate pentahydrate
30 g/l sodium sulfite
0.5 g/l molybdenum (VI) acid
is prepared and adjusted to a pH of 8.0. The solution is clear. After 28 days in a closed vessel at 21° C. under artificial light, no change was observed. If a conductive substrate with a platinized counterelectrode is dipped into the solution with the aged formulation according to Example 4 and a voltage with a resulting cathodic current density of 0.5 A/dm$^2$ is applied at 40° C., it results in a pore-free, fine crystalline deposition of an alloy of gold and silver. The solution remains clear and shows no particle precipitations.

Example 5

An aqueous solution with
20 g/l gold in the form of sodium disulfitoaurate
5.3 g/l silver in the form of silver chloride
150 g/l sodium thiosulfate pentahydrate
30 g/l sodium sulfite
0.5 g/l chromium (VI) oxide
is prepared and adjusted to a pH of 7.8. The solution is bluish and clear. If a conductive substrate with a platinized counterelectrode is dipped into the solution with the formulation according to Example 5 and a voltage with a resulting cathodic current density of 0.5 A/dm$^2$ is applied at 40° C., it results in a pore-free, fine crystalline deposition of an alloy of gold and silver. The solution remains clear and shows no particle precipitation. After another 10 weeks in a closed vessel at 21° C. under artificial light, no change was observed.

Example 6

An aqueous solution with
20 g/l gold in the form of sodium disulfitoaurate
5.3 g/l silver in the form of silver chloride
150 g/l sodium thiosulfate pentahydrate
30 g/l sodium sulfite
5 g/l acrylic acid-maleic acid copolymer (molar mass~3000)
0.5 g/l tungsten (VI) acid
is prepared and adjusted to a pH of 7.8. The solution is clear. If a conductive substrate with a platinized counterelectrode is dipped into the solution with the formulation according to Example 5 and a voltage with a resulting cathodic current density of 0.5 A/dm$^2$ is applied at 40° C., it results in a pore-free, fine crystalline deposition of an alloy of gold and silver. The solution remains clear and shows no particle precipitation. After another 10 weeks in a closed vessel at 21° C. under artificial light, no change was observed.

Example 7

An aqueous solution with
14.7 g/l gold in the form of sodium disulfitoaurate
5.3 g/l silver in the form of silver chloride
150 g/l sodium thiosulfate pentahydrate
30 g/l sodium sulfite
0.5 g/l molybdenum (VI) oxide
is prepared and adjusted to a pH of 7.8. The solution is clear. If a conductive substrate, which is masked with a photolithographically structured resist and the masking of which has been exposed in a proportion of 2.5% with square openings of 40 μm edge length, is dipped into the solution with the formulation according to Example 7 using a platinized counterelectrode and if a voltage is applied at 40° C., it leads to the resulting cathodic current density
of 1.0 A/dm$^2$ to a pore-free, fine-crystalline alloy deposit with an average gold content of 12 percent by weight,
of 1.5 A/dm$^2$ to a pore-free, fine-crystalline alloy deposit with an average gold content of 24 percent by weight, and
of 2.0 A/dm$^2$ to a pore-free, fine-crystalline alloy deposit with an average gold content of 41 percent by weight,
wherein the solution remains clear and shows no particle precipitations.

Example 8

An aqueous solution with
16.8 g/l gold in the form of sodium disulfitoaurate
3.1 g/l silver in the form of silver chloride
150 g/l sodium thiosulfate pentahydrate
30 g/l sodium sulfite
0.5 g/l molybdenum (VI) oxide
is prepared and adjusted to a pH of 7.8. The solution is clear. If a conductive substrate, as described in more detail in Example 7, is dipped with a platinized counterelectrode into the solution with the formulation according to Example 8 and a voltage is applied at 40° C., it leads to the resulting cathodic current density of 1.0 A/dm$^2$ to a pore-free, fine-crystalline alloy deposit with an average gold content of 42 percent by weight, of 1.5 A/dm$^2$ to a pore-free, fine-crystalline alloy deposit with an average gold content of 55 percent by weight, and of 2.0 A/dm$^2$ to a pore-free, fine-crystalline alloy deposit with an average gold content of 75 percent by weight, wherein the solution remains clear and shows no particle precipitations.

Example 9

An aqueous solution is prepared with an identical formulation as in Example 7 and adjusted to a pH of 7.8. The solution is clear. If a conductive substrate, which is masked with a photolithographically structured resist and the masking of which has been exposed in a proportion of 30% with square openings of 80 μm edge length, is dipped into the solution with the formulation according to Example 7 using a platinized counterelectrode and if a voltage is applied at 40° C., it leads to the resulting cathodic current density of 0.5 A/dm$^2$ to a pore-free, fine-crystalline alloy deposit with an average gold content of 33 percent by weight, and of 0.7 A/dm$^2$ to a pore-free, fine-crystalline alloy deposit with an average gold content of 50 percent by weight, wherein the solution remains clear and shows no particle precipitations.

The invention claimed is:

1. A cyanide-free, metal salt-containing aqueous formulation for the electrodeposition of a layer of gold and silver on an electrically conductive substrate, comprising:

at least one gold salt and at least one silver salt, at least one first complexing agent from the group of thiosulfates, at least one second complexing agent from the group of sulfites, and at least one soluble oxygen acid of a transition metal selected from the 5th or the 6th group of the periodic table.

2. The formulation according to claim 1, wherein the transition metal of the 5th or the 6th group is selected from the group consisting of vanadium, chromium, molybdenum, and tungsten.

3. The formulation according to claim 1, wherein the at least one oxygen acid of the transition metal is contained in the form of its soluble salt, and/or in the form of an isolated metallic acid thereof, and/or in the form of an anhydride thereof.

4. The formulation according to claim 1, wherein the at least one oxygen acid of the transition metal is contained in a concentration of 0.1 mmol/l to 1000 mmol/l.

5. The formulation according to claim 1, wherein the gold is contained in the form of monovalent gold cations, and/or the silver is contained in the form of monovalent silver cations.

6. The formulation according to claim 1, wherein the gold salt is contained in a concentration of 2 g/l to 60 g/l, and/or the silver salt is contained in a concentration of 2 g/l to 60 g/l.

7. The formulation according to claim 1, wherein the first complexing agent from the group of thiosulfates is contained as a salt of thiosulfuric acid.

8. The formulation according to claim 1, wherein the first complexing agent from the group of thiosulfates is contained, based on the total amount of gold and silver, in excess and in a concentration of 0.2 mol/l to 1.5 mol/l.

9. The formulation according to claim 1, wherein the second complexing agent from the group of sulfites is contained as a salt of sulfurous acid or as a salt of disulfurous acid.

10. The formulation according to claim 1, wherein the second complexing agent from the group of sulfites is contained in a concentration of 0.1 mol/l to 1 mol/l.

11. The formulation according to claim 1, wherein the formulation contains at least one buffer substance selected from the group consisting of aliphatic polycarboxylic acids, hydroxycarboxylic acids, and weak polyprotonic inorganic acids.

12. The formulation according to claim 1, wherein the formulation contains at least one substance selected from acrylic acid polymers (I), methacrylic acid polymers (II), and acrylic acid-maleic acid copolymers (III), of the general formula,

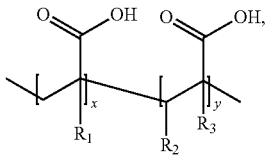

(I), (II), or (III)

wherein:

in the acrylic acid polymers of formula (I): $R_1$, $R_2$, and $R_3$ are each a hydrogen ion, in the methacrylic acid polymers of formula (II): $R_1$ and $R_3$ are each a methyl group and $R_2$ is a hydrogen ion, and in acrylic acid-maleic acid copolymers of formula (III): $R_1$ and $R_3$ are each a hydrogen ion and $R_2$ is a carboxyl group.

13. The formulation according to claim 12, wherein the at least one substance is present in a concentration of 1 g/l to 100 g/l.

14. The formulation according to claim 1, wherein the formulation contains at least one substance selected from the group consisting of ketocarboxylic acids, in the form of the acid or the salt thereof, wherein the at least one substance is present in a concentration of 1 g/l to 100 g/l.

15. The formulation according to claim 1, having a pH of 6.5 to 12.

16. The formulation according to claim 1, which further contains at least one grain-refining additive which inhibits metal deposition and prevents crystal growth.

17. The formulation according to claim 1, which contains at least one surface-active additive selected from the group of anionic, cationic, amphoteric, and nonionic surfactants.

18. A method for the electrodeposition of a layer of gold and silver on an electrically conductive substrate comprising completely or partially immersing the substrate in the formulation of claim 1 and applying an electrical voltage between the catholically polarized substrate and at least one anodically polarized counter electrode.

19. The method according to claim 18, wherein the substrate is exposed directly by the solution, at least in the area of a surface to be coated, by utilizing a suitable nozzle or paddle device.

20. The method according to claim 18, wherein the substrate comprises a substantially plate-shaped metallic or metallized workpiece, and the surface to be electrodeposited is either partially masked with a non-conductive layer or is unmasked.

21. The method according to claim 18, wherein the deposition of gold and silver takes place simultaneously and the deposited layer or the deposited deposits have a gold content in a range from 15 percent by weight to 85 percent by weight.

* * * * *